US009587399B2

(12) United States Patent
Jakobsen et al.

(10) Patent No.: US 9,587,399 B2
(45) Date of Patent: Mar. 7, 2017

(54) INSULATING WALL, A COLUMN ASSEMBLY THEREFORE AND A METHOD OF CONSTRUCTING SUCH AN INSULATING WALL

(71) Applicant: Rockwool International A/S, Hedehusene (DK)

(72) Inventors: Klavs Koefoed Jakobsen, Roskilde (DK); Preben Riis, Lejre (DK)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 14/892,856

(22) PCT Filed: May 15, 2014

(86) PCT No.: PCT/EP2014/059954

§ 371 (c)(1),
(2) Date: Nov. 20, 2015

(87) PCT Pub. No.: WO2014/187726

PCT Pub. Date: Nov. 27, 2014

(65) Prior Publication Data

US 2016/0115690 A1 Apr. 28, 2016

(30) Foreign Application Priority Data

May 21, 2013 (EP) ..... 13168544

(51) Int. Cl.
*E04C 2/24* (2006.01)
*E04B 1/18* (2006.01)
(Continued)

(52) U.S. Cl.
CPC ..... *E04C 2/243* (2013.01); *E04B 1/18* (2013.01); *E04B 1/7608* (2013.01);
(Continued)

(58) Field of Classification Search
CPC ..... E04C 2/243; E04C 3/36; E04B 2/562; E04B 1/7608; E04B 1/7658; E04B 1/80; E04B 1/18; E04B 1/78
See application file for complete search history.

(56) References Cited

U.S. PATENT DOCUMENTS 1,491,112 A * 4/1924 Spink ..... E04C 2/243 428/128
3,332,170 A * 7/1967 Bangs ..... B61D 17/18 49/400

(Continued)

FOREIGN PATENT DOCUMENTS

WO 2008116281 A1 10/2008
WO 2011000378 A2 1/2011
WO 2011135322 A1 11/2011

OTHER PUBLICATIONS

International Search Report and Written Opinion issued in co-pending interntaional application No. PCT/EP2014/059954, mailed Jul. 24, 2014.

*Primary Examiner* — Brian Glessner
*Assistant Examiner* — Paola Agudelo
(74) *Attorney, Agent, or Firm* — Dinsmore & Shohl LLP; Douglas Wathen

(57) ABSTRACT

The present invention concerns a columns assembly for an insulating wall of a building structure, said column having a side surfaces adapted to receive and retain insulation panels of the insulating wall, said column assembly comprising an inner spacer element made of mineral wool fibers, a central element made of mineral wool fibers, an outer spacer element made of mineral wool fibers, wherein the spacer elements are assembled with first and second intermediate profiles between the spacer elements, and wherein the density of the mineral wool in the central element is higher than the density in the inner and outer spacer ele-
(Continued)

ments. The invention also concerns an insulating wall assembly of a building structure with such a column assembly and a method of constructing such insulating wall.

19 Claims, 4 Drawing Sheets

(51) Int. Cl.
*E04C 3/36* (2006.01)
*E04B 1/76* (2006.01)
*E04B 1/80* (2006.01)
*E04B 2/56* (2006.01)

(52) U.S. Cl.
CPC ..... *E04B 1/7658* (2013.01); *E04B 1/80* (2013.01); *E04B 2/562* (2013.01); *E04C 3/36* (2013.01)

(56) References Cited

U.S. PATENT DOCUMENTS 3,583,118 A * 6/1971 Lowery ..... E04C 2/296 264/46.5
3,999,343 A * 12/1976 Roberts ..... E04B 2/7412 52/241
4,114,334 A * 9/1978 Thoren ..... E04C 2/30 52/302.3
4,224,774 A * 9/1980 Petersen ..... E04B 2/707 52/309.14
4,658,557 A * 4/1987 Mulford ..... E04B 2/706 52/407.1
4,937,122 A * 6/1990 Talbert ..... B32B 3/22 428/120
5,399,408 A * 3/1995 Nowara ..... B32B 3/26 220/592.21
5,640,824 A * 6/1997 Johnson ..... E04B 7/22 52/284
6,125,608 A * 10/2000 Charlson ..... E04B 1/7604 52/404.1
6,494,012 B2 * 12/2002 Seng ..... E04B 1/24 52/309.14
8,516,778 B1 * 8/2013 Wilkens ..... E04C 3/292 52/309.13
9,103,113 B2 * 8/2015 Lockhart ..... E04B 2/7412
2012/0011793 A1 * 1/2012 Clark ..... E04C 3/122 52/309.4
2013/0171900 A1 * 7/2013 Bauer ..... B32B 5/02 442/181

* cited by examiner

INSULATING WALL, A COLUMN ASSEMBLY THEREFORE AND A METHOD OF CONSTRUCTING SUCH AN INSULATING WALL

CROSS-REFERENCE TO RELATED APPLICATIONS

This application is the U.S. national phase of international application Ser. No. PCT/EP2014/059954, filed May 15, 2014, which claims priority to European application Serial No. EP 13168544.8, filed May 21, 2013, the contents of which are incorporated herein in their entirety.

FIELD OF THE INVENTION

The present invention relates to an insulating building envelope structure, in particular an insulating wall assembly of such a building structure, a column assembly therefore and a method of constructing such an insulating wall.

BACKGROUND OF THE INVENTION

In WO2009/153232 there is disclosed an insulating building system for an external building structure, such as a wall or a roof, or an internal building structure of the above-mentioned kind. This building assembly comprises a top and a bottom profile with a plurality of joining profiles between the top and bottom frame profiles. The joining profiles have a first and second side surfaces which are abutted by the contact sides of adjacent insulating panels on each side of said joining profiles, wherein the profile contact sides of the insulation panels are provided with a shape matching the profile side surfaces of the joining profiles such that the insulation panels are retained between two profiles. The insulation panels thereby support the joining profiles and provide stability and strength to the wall structure and prevent the joining profiles from buckling.

In WO 00/26483 a method and a profile for connecting building blocks is described resulting in a wall in a building system. According to this method, two construction blocks are joined along an edge face of each block abutting each other by a profile having a web and two flanges on each side with a perpendicularly extending flap at the distal ends of these two flanges. These flaps are inserted into a groove in the construction blocks whereby the blocks are held together.

These known building assembly systems are advantageous in the way they contain prefabricated construction blocks which may be produced off site and transported to the building site together with steel profiles and other materials and may be assembled on the building site. Although the profiles are at least partly covered in insulation material, the normally vertically oriented, spaced apart profiles constitute substantial thermal bridges in the wall assembly. Since there's a constant need to further improve the thermal performance of the building envelope due to increased focus on energy savings as e.g. defined by the European Directive "Energy Performance of Buildings" (EPBD) for the EU territory, such thermal bridges will have to be further eliminated. The headline target or objective of the EPBD defines increased energy efficiency in the Union resulting in a saving of 20% of the Union's primary energy consumption by 2020 compared to projections. That's why regulations or guidelines like e.g. the Passive House guidelines by the German Passive House Institute (PHI), Darmstadt and others define certain requirements for future building components as well as total building concepts in respect to thermal performance, thermal bridging, air-tightness etc. Today's known building assemblies as mentioned before will not meet these criteria due to the fact that they often make use of traditional steel profiles in order to provide the necessary load-bearing capacity for the buildings. Moreover, they only constitute the central load-bearing part of a wall structure which still needs to be further furnished in order e.g. to install the service or installation layer, a bracing layer, an air-tightness layer as well as sub-constructions for the final outer and inner cladding. These additional working steps are often provided by additional or different traders, which makes building processes complex and error-prone.

SUMMARY OF THE INVENTION

It is therefore an object of the present invention to provide an insulating building envelope structure, in particular an insulating wall assembly with excellent thermal performance already today meeting future requirements, which is substantially thermal bridge free and which is easy and fast to install on site.

In a first aspect this object is achieved by a column assembly for a substantially thermally bridge free insulating wall of a building structure, said column profile having a side surfaces adapted to receive and retain insulation panels of the insulating wall, said column assembly comprising an inner spacer element made of mineral wool fibres, a central element made of mineral wool fibres, and an outer spacer element made of mineral wool fibres, wherein the spacer elements are assembled with first and second intermediate profiles between the spacer elements, and wherein the density of the mineral wool in the central element is higher than the density in the inner and outer spacer elements and preferably wherein the central element is thinner than the inner and outer spacer elements. Thereby, in order to simplify the mounting process on-site and to secure safe installation of all components of an insulating wall the said column provides a specific multi-purpose functionality which will be described in more detail later. In relation to the use of the term "substantially thermally bridge free", this term should be understood in the context of the above explained Passive House guidelines.

In another aspect of the invention, there is provided an insulating wall assembly of a building structure, preferably an external wall assembly, comprising at least a base profile, preferably C-shaped and substantially horizontally oriented, with a plurality of such column assembly profiles, preferably substantially vertically oriented, wherein the column assemblies have first and second side surfaces, which are abutted by the contact sides of a plurality of insulating panels fitted between two adjacent column assemblies.

The columns according to the invention are advantageous due to a very low thermal conductivity; thereby eliminating thermal bridging according to Passive House Institute (PHI) guidelines. The thermal performance of a column according to the invention, when considered a building component following the concept of the PHI guidelines, is better than $\psi \leq 0.00499$ W/mK which is regarded as a thermal bridge free construction according to the above referenced PHI guidelines. This is ensured by its novel triple thermal bridge break system. Moreover, since the column assembly of the invention is only made of mainly in-organic materials in all critical areas, the assembly as well as the total insulating wall assembly is moisture safe.

In the insulating wall assembly the columns are stabilised by mineral wool fibre insulation boards. It is advantageous that the insulation boards are standardised boards, which are provided in a plurality of layers in the wall assembly. Said columns have a specific design able to retain all the different layers of the wall. This ensures a safe installation process and makes the wall assembly a relative simple operation to install. In this building system the columns have a multi-purpose functionality. Preferably, the inner spacer element is provided with an innermost mounting element for supporting the mounting of the inner wall finish. Likewise, the outer spacer element is preferably also provided with an outermost mounting element for supporting the mounting of the external building facade cladding. Hereby, when the columns are installed, the core part of the wall assembly is installed and the basis for a fixing free installation of the insulation, the sub-construction for an external building cover, such as the cladding, and a sub-construction for the inner wall cover are in place. By the invention it is realised that an insulating wall assembled in this manner and with no thermal bridging as all parts of the wall perform better than $\psi \leq 0.00499$ W/mK are approx. 20% thinner than know insulating wall systems which have the corresponding thermal insulating properties.

In an embodiment, the outermost mounting element is wider than the outer spacer element. Hereby, a small recess is provided on each side of the column which act as a stop for the outer insulation panel, which thereby is retained in the mounted position. All the different layers of insulation are retained without other retention means than by the column's support due to its special design.

In the preferred embodiment of the column assembly, the innermost and/or the outermost mounting elements are made of plywood. This allows for an easy fixation of the inner and outer wall cover by standard fastening screws or the like.

In a preferred embodiment, the first and second intermediate profiles are made of steel, preferably a bent steel sheet. Hereby, two inexpensive profiles are provided which are shaped to fit tightly around the inner and outer ends of the central element and provide a good planar receiving surface for, respectively, the inner and outer spacer elements. Furthermore, the first intermediate profile may be the innermost profile and is wider than the outermost second intermediate profile.

In an advantageous embodiment of the column assembly according to the invention, the central element has a density of 300-600 kg/m$^3$, preferably approx. 500 kg/m$^3$. Moreover, the inner and outer spacer elements have a density of 70-100 kg/m$^3$, preferably approx. 90 kg/m$^3$. Hereby, the column assembly has a good bending stiffness and excellent load bearing capabilities. Another example of a column is known from an earlier European patent application no. EP 12198244.1 (not yet published).

In the preferred embodiment of the column assembly, the inner and outer mounting elements, the inner and outer spacer elements, the first and second intermediate profiles and the central element are symmetrically assembled about a longitudinal axis.

In a preferred embodiment of an insulating wall assembly of the invention, an inner, a middle and an outer insulation panel of mineral wool fibre insulation panels are provided between the column assemblies, wherein the middle insulation panel is abutting the central element of the column assemblies and retained between the intermediate profiles of the column assemblies. The middle insulation panel due to its density constituting to the load-bearing part of the construction in connection with the central column part, i.e. the intermediate profiles combined with the central element out of mineral fibres. Said middle insulation has therefore a higher density than the inner and outer insulation panels, preferably where the middle insulation panel has a density of 60-80 kg/m$^3$, more preferably approx. 70 kg/m$^3$, and the inner and outer insulation panels preferably have a density in the range of 35-50 kg/m$^3$, more preferably approx. 45 kg/m$^3$.

Hereby, there is provided a comprehensive wall system which has no need of a wind barrier and when installed is ready for finishing inner and outer cladding. This makes the system a very fast in-situ building system to install and tests have shown that the installation time may be up to 30% faster than the known systems.

Preferably, a screen panel, such as a wooden panel or engineered wood particle board, like e.g. an OSB board, is provided between the middle insulation panel and the inner insulation panel. Hereby, the wall system is provided with a "built-in" air-tightness layer.

According to a third aspect of the invention, there is provided a method of constructing an insulating wall comprising the steps of:

- providing a first column assembly on a base structure;
- placing a middle insulation panel of mineral wool fibres abutting the central element of the first column assembly, and then
- providing a second column assembly on the base structure and with the central element of said second column assembly fitted around the middle insulation panel;
- placing an outer insulation panel of mineral wool fibres between the outer spacer elements of two neighbouring first and second column assemblies;
- installing a screen panel, such as a wooden panel, on the inside of the middle insulation panel; and
- placing an inner insulation panel of mineral wool fibres between the inner spacer elements of two neighbouring first and second column assemblies on the inside of the screen panel.

Hereby, an easy and fast construction of an insulating wall may be achieved. The wall assembly is ready for receiving its internal and external wall claddings without a need to prepare the wall assembly therefore, i.e. there is principally no need for any additional mounting of a sub-construction as normally would be required, no mounting of foils, tape or the like.

In a further embodiment, the method further comprises the step of mounting an inner wall structure, such as gypsum boards, on the inner mounting elements of the column assemblies. In addition, the method preferably also includes the step of mounting an outer wall structure, such as a façade cladding or facing bricks, on the outer mounting elements of the column assemblies.

BRIEF DESCRIPTION OF THE DRAWINGS

In the following, the invention is described in more detail with reference to the accompanying drawings, in which.

DETAILED DESCRIPTION OF THE INVENTION

Figure 1:
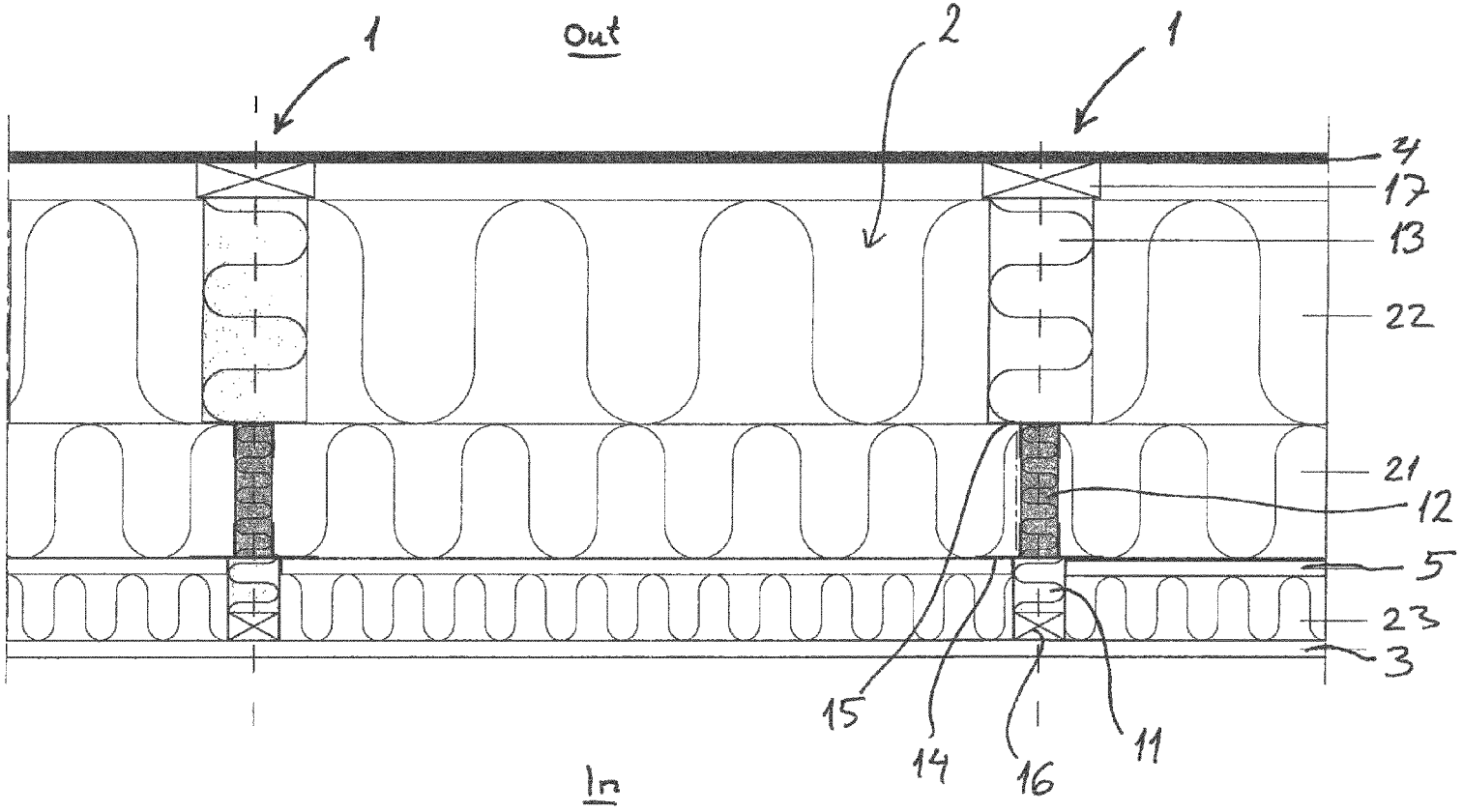
FIG. 1 is a schematic cross-sectional view of an insulating wall assembly according to an embodiment of the invention.

With reference to FIG. 1, an insulating wall assembly according to an embodiment of the invention comprise a plurality of column assemblies 1 of which two are shown in the figure. Between the column assemblies 1 three layers of mineral fibre boards 2 are accommodated. On the inside the wall assembly is provided with an internal wall cover 3, such as gypsum boards. On the outside of the wall assembly there is provided an outer building cover 4. A screen panel 5 is provided between the middle insulation panel 21 and the innermost insulation panel 23. The screen panel 5 may be a plywood board.

Figure 2:
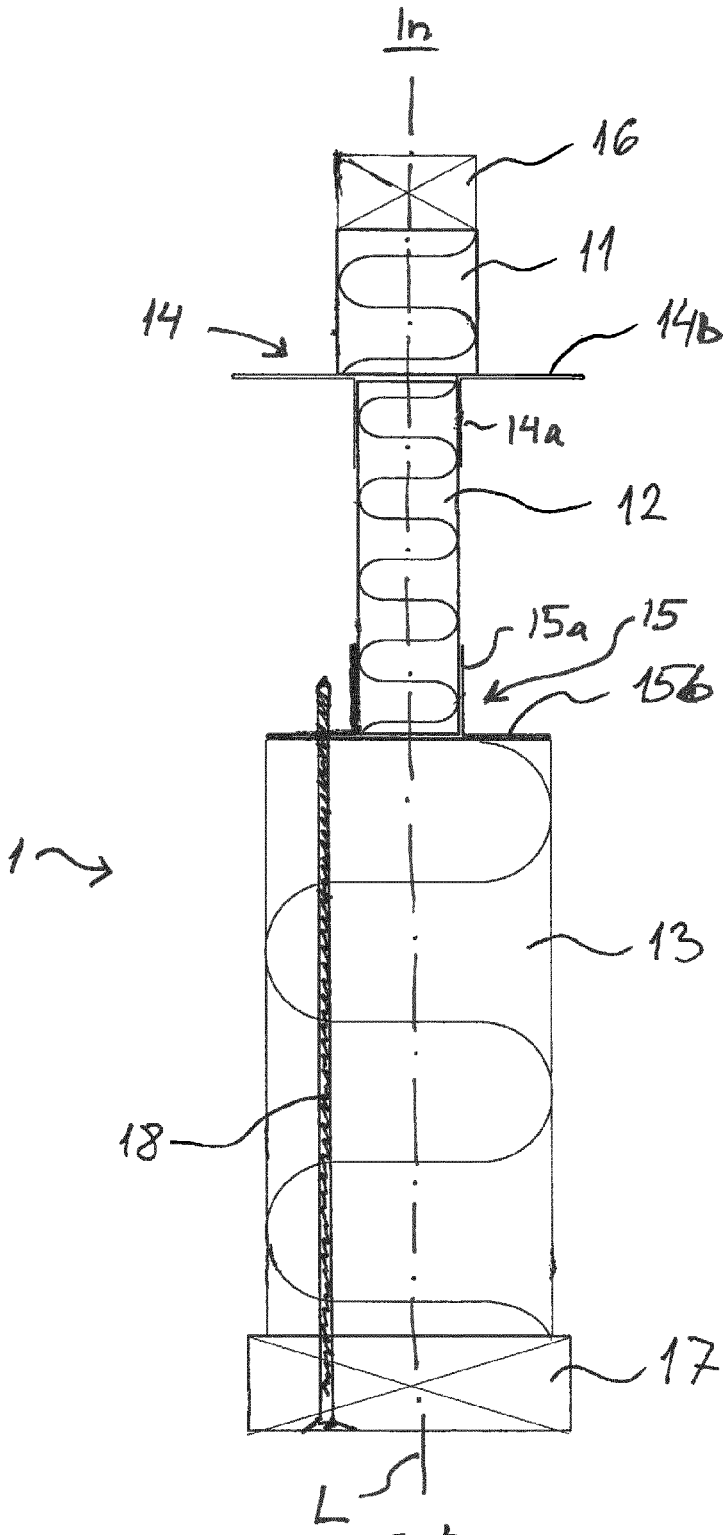
FIG. 2 is a cross-sectional view of a columns assembly according to an embodiment of the invention.
Figure 3:
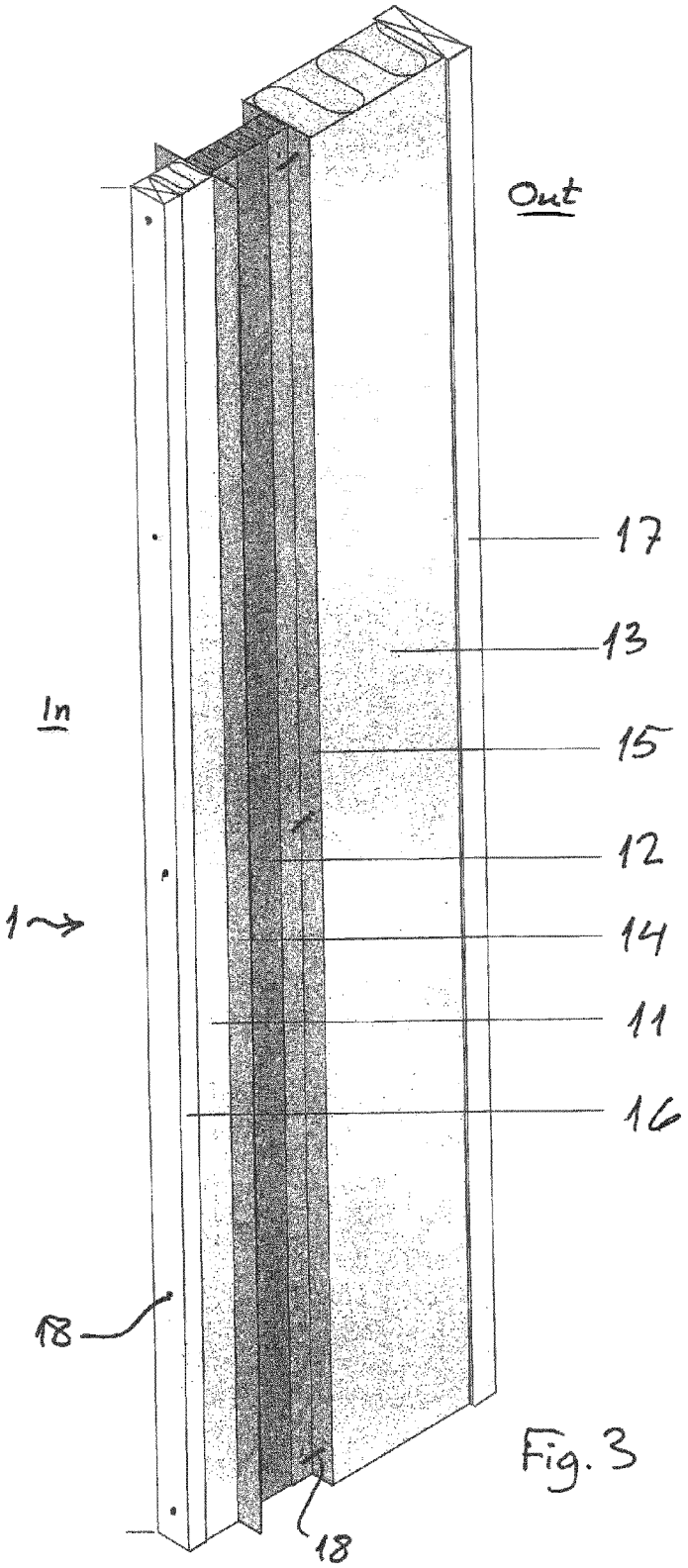
FIG. 3 is a schematic perspective view of the columns assembly of FIG. 2.

The column assembly 1 is shown in isolation and in more detail in the FIGS. 2 and 3. The column assembly 1 is made up by a central element 12, which is preferably made by a high density mineral wool fibre board, having a density of approx. 500 kg/m3. On each side of the central element 12, an outer spacer element 13 and an inner spacer element 11 are provided along a longitudinal symmetry axis L, which is preferably substantially perpendicular to the plane of the wall assembly.

A first intermediate profile 14 is provided between the central element 12 and the inner spacer element 11. The first profile 14 is provided with two upright flanges 14*a* in between which the central element 12 fits tightly. The first profile 14 is further provided with transverse flanges 14*b* extending in a direction perpendicular to the longitudinal axis L and in the plane of the insulating wall assembly. The transverse flanges 14*b* provide a planar inner surface onto which the inner spacer element 11 is fixed. The first profile 14 is preferably wider than the width of the inner spacer element 11 whereby the flanges 14*b* can act as support flanges for the middle insulation panel 21 on the outside of the flanges and as mounting flanges for the screen panel 5 on the inside.

A second intermediate profile 15 is provided between the central element 12 and the outer spacer element 13. The second profile 15 is provided with two upright flanges 15*a* in between which the central element 12 fits tightly. The second profile 15 is further provided with transverse flanges 15*b* extending in a direction perpendicular on the longitudinal axis L. The transverse flanges 15*b* provide a planer outer surface onto which the outer spacer element 13 is fixed. The width of the second profile 15 corresponds to the thickness of the outer spacer element 13. The first profile 14 is preferably wider than the second profile 15.

The profiles 14, 15 are fixed to the central element 12 by suitable means, such as glue and/or fastening means, like e.g. screws, bolts, rivets etc.

Mounting elements 17 are provided on the distal ends of the spacer elements 11, 13. The inner mounting element 16 is preferably provided with a width similar to the inner spacer element 11, whereas the outer mounting element 17 is slightly wider than the outer spacer element 13. Hereby, a recess is created on each side of the column assembly 1 which will act as a natural stop for the insulation panels and thereby facilitate the installation of the wall assembly.

The mounting elements 16, 17 may be fixed to the spacer elements by suitable means, such as glue and/or fastening screws 18 which penetrate through the spacer element 13 for fixation in the transverse flanges 15*b*. A similar arrangement may suitably be provided in relation to the inner mounting element 16 (not shown in FIG. 2, but see FIG. 3). The fastening screws 18 may be provided in the central longitudinal line L of the column assembly 1 or parallel to but off-set from this line L.

The wall assembly includes three layers of insulation panels 21, 22, 23. The middle insulation panel 21 fits between the transverse flanges 14*b*, 15*b* of the column assemblies 1. This middle insulation panel 21 has a higher density than the inner and outer insulation panels 22, 23. Accordingly, in an embodiment the middle insulation panel 21 has a density of 60-80 kg/m$^3$, preferably approx. 70 kg/m$^3$, and the inner and outer insulation panels 22, 23 preferably have a density in the range of 35-50 kg/m$^3$, more preferably approx. 45 kg/m$^3$.

In an embodiment, the central element 12 of the column assembly 1 has a density of 300-600 kg/m$^3$, preferably approx. 500 kg/m$^3$. The inner and outer spacer elements 11, 13 have a density of 70-100 kg/m$^3$, preferably approx. 90 kg/m$^3$. The mounting elements 16, 17 are preferably made of plywood. Hereby, a column assembly is achieved which has a good bending stiffness and very good thermal insulation properties.

In the preferred embodiment, the first and second intermediate profiles 14, 15 are made of steel, preferably a profiles formed by bending a steel strip.

The installation of the wall assembly is fast and simple. A first column assembly 1 on a base structure. The middle insulation panel 21 of mineral wool fibres abutting the central element 12 of the first column assembly 1, and then mounted spaced apart in a vertical orientation with a predetermined distance on a preferably horizontal base structure a second column assembly 1 is positioned on the base structure and with the central element 12 of said second column assembly 1 fitted around the middle insulation panel 21. The outer insulation panel 22 of mineral wool fibres may then be fitted between the outer spacer elements 13 of the two neighbouring first and second column assemblies 1. Before fitting the inner insulation panel 23 of mineral wool fibres between the inner spacer elements 11 of two neighbouring column assemblies 1, the screen panel 5, such as the plywood panel, is mounted between the column assemblies 1 and fixed to the flanges 14*b* of the first intermediate profiles 14 of the two neighbouring column assemblies 1. When the air-tightness of the wall assembly is thereby secured, the inner insulation panel 23 of mineral wool fibres is then fitted between the inner spacer elements 11 of two neighbouring column assemblies on the inside of the screen panel 5.

When the insulation 2 is installed between the column assemblies 1, the inner cladding 3 and the outer cladding 4 is easily mounted onto the mounting elements 16, 17 of the column assemblies 1. Furthermore, if electrical cabling or the like is needed to be concealed in the wall assembly, it is by the invention realised that this cabling may be installed before the fitting of the inner insulation boards 23 so that this fitting is automatically concealed when the inner cladding 3, such as the gypsum boards, are mounted.

Figure 4:
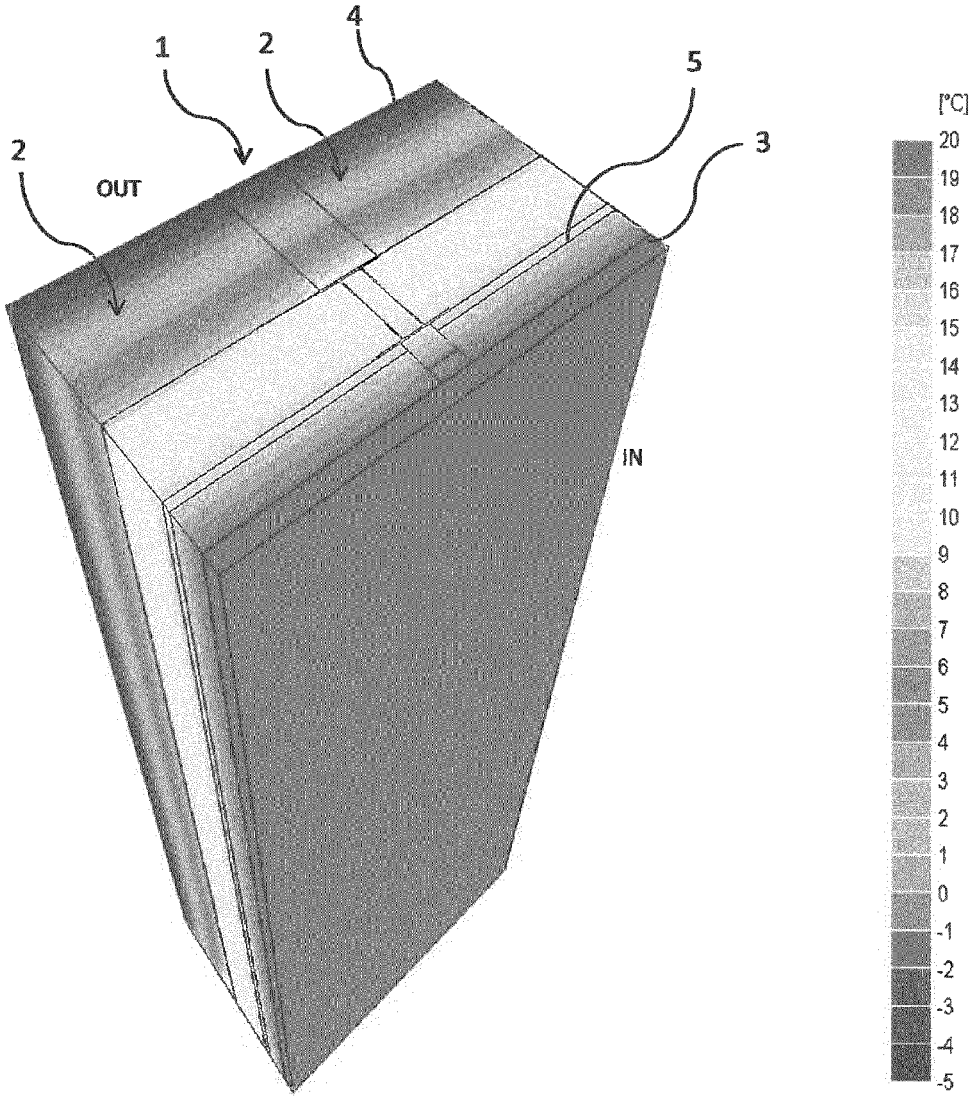
FIG. 4 is a thermo-graphic calculation of the insulating wall assembly.

In the following an example of an embodiment of a wall assembly according to the invention is described with reference to FIG. 4. FIG. 4 shows a thermo-graphic calculation of the U-value of the whole insulating wall assembly with the dimensions and materials described below. A wall assembly according to this example results in a U-value of 0.1 W/m$^2$K.

According to this example, the column assembly 1 is made of an outer spacer element 13, which is made of mineral wool fibres with a density of 93 kg/m$^3$ with the dimensions of 80×170 mm. The inner spacer element 11 is made of a mineral wool fibre element with a density of 93 kg/m$^3$ with the dimensions of 40×41 mm. The central element 12 is made of a mineral wool fibre board with the dimensions of 28×98 mm with a high density of approx. 500 kg/m$^3$. The mounting panels are made of plywood with a thickness of 27 mm.

In between the high performing column assemblies, three layers of mineral wool fibre insulation panels are fitted:

The outer insulation panel has a thickness of 170 mm and a density of 45 kg/m$^3$, made of a mineral fibre wool material having lambda value declared at 0.034 W/mK.

The central insulation panel has a thickness of 100 mm and a density of 70 kg/m$^3$, made of a mineral fibre wool material having lambda value declared at 0.033 W/mK.

The wooden screen panel is a 12 mm OSB board.

The inner insulation panel has a thickness of 50 mm and a density of 45 kg/m$^3$, made of a mineral fibre wool material having lambda declared 0.034 W/mK.

Hereby, there is achieved an U-value of 0.10 W/m$^2$K (0.1045) and a total thickness of 332 mm excl. inner and outer cladding.

The present invention has in details been described in terms of an insulating wall system comprising the novel column profiles. However, it should be noted that the technical teaching also applies to a similar roof construction as part of an insulating building envelope structure.

The invention claimed is:

1. A column assembly for a substantially thermal bridge free insulating wall of a building structure, said column assembly having side surfaces adapted to receive and retain insulation panels of the insulating wall, said column assembly comprising:

an inner spacer element made of mineral wool fibres;

a central element made of mineral wool fibres;

an outer spacer element made of mineral wool fibres;

wherein the spacer elements are assembled with first and second intermediate profiles between the spacer elements, and wherein the density of the mineral wool in the central element is higher than the density in the inner and outer spacer elements, whereby a substantially thermal-bridge-free load bearing column is provided.

2. A column assembly according to claim 1, wherein the column assembly provides a thermal performance of $\Psi \leq 0.00499$ W/mK.

3. A column assembly according to claim 1, wherein the central element is thinner than the inner and outer spacer elements.

4. A column assembly according to claim 1, wherein the inner spacer element is provided with an innermost mounting element for supporting a mounting of an inner wall finish.

5. A column assembly according to claim 4, wherein the innermost mounting element is made of plywood.

6. A column assembly to claim 1, wherein the outer spacer element is provided with an outermost mounting element for supporting a mounting of an external building facade cladding.

7. A column assembly according to claim 6, wherein the outermost mounting element is wider than the outer spacer element.

8. A column assembly according to claim 1, wherein the first and second intermediate profiles are made of steel or of a bent steel sheet.

9. A column assembly according claim 1, wherein the central element has a density of 300-600 kg/m$^3$ or of approx. 500 kg/m$^3$.

10. A column assembly according to claim 1, wherein the inner and outer spacer elements have a density of 70-100 kg/m$^3$ or of approx. 90 kg/m$^3$.

11. A column assembly according to claim 1, wherein the inner and outer spacer elements, the first and second intermediate profiles and the central element are symmetrically assembled about a longitudinal axis.

12. A method of constructing an insulating wall comprising the steps of:

providing a first column assembly according to claim 1 on a base structure;

placing a middle insulation panel of mineral wool fibres abutting the central element of the first column assembly, and then providing a second column assembly according to claim 1 on the base structure and with the central element of said second column assembly fitted around the middle insulation panel;

placing an outer insulation panel of mineral wool fibres between the outer spacer elements of two neighboring first and second column assemblies;

installing a screen panel on the inside of the middle insulation panel; and placing an inner insulation panel of mineral wool fibres between the inner spacer elements of two neighboring first and second column assemblies on the inside of the screen panel.

13. A method according to claim 12, further comprising the step of mounting an inner wall structure on inner mounting elements of the first and second column assemblies.

14. A method according to claim 12, further comprising the step of mounting an outer wall structure on outer mounting elements of the column assemblies.

15. An insulating wall assembly of a building structure, comprising:

at least a base structure;

a plurality of column assemblies;

the column assemblies each having first and second side surfaces, which are abutted by contact sides of a plurality of insulating panels fitted between two adjacent column assemblies, wherein the column assemblies each comprise an inner spacer element made of mineral wool fibres;

a central element made of mineral wool fibres;

an outer spacer element made of mineral wool fibres;

wherein the spacer elements are assembled with first and second intermediate profiles between the spacer elements, and wherein the density of the mineral wool in the central element is higher than the density in the inner and outer spacer elements, whereby a substantially thermal-bridge-free load bearing column is provided.

16. An insulating wall assembly according to claim 15, wherein the wall assembly provides a U-value of below 0.15 W/m$^2$K, preferably 0.10 W/m$^2$K.

17. An insulating wall assembly according to claim 15, wherein an inner, a middle and an outer insulation panel of mineral wool fibre insulation panels are provided between the column assemblies, and wherein the middle insulation panel is abutting the central element of the column assemblies and retained between the intermediate profiles on the column assemblies.

18. An insulating wall assembly according to claim 17, wherein the middle insulation panel has a higher density than the inner and outer insulation panels, the middle insulation panel having a density of 60-80 kg/m$^3$and the inner and outer insulation panels have a density in the range of 35-50 kg/m$^3$.

19. An insulating wall assembly according to claim 17, wherein a screen panel is disposed between the middle insulation panel and the inner insulation panel.

* * * * *